US006896213B2

(12) United States Patent
Loesche

(10) Patent No.: US 6,896,213 B2
(45) Date of Patent: May 24, 2005

(54) DEVICE FOR SUPPLYING A MATERIAL

(75) Inventor: Thomas Loesche, Ratingen (DE)

(73) Assignee: Loesche GmbH, Dusseldorf (DE)

( * ) Notice: Subject to any disclaimer, the term of this patent is extended or adjusted under 35 U.S.C. 154(b) by 0 days.

(21) Appl. No.: 10/474,234

(22) PCT Filed: Apr. 2, 2002

(86) PCT No.: PCT/EP02/03636

§ 371 (c)(1),
(2), (4) Date: Mar. 15, 2004

(87) PCT Pub. No.: WO02/081090

PCT Pub. Date: Oct. 17, 2002

(65) Prior Publication Data

US 2004/0140177 A1 Jul. 22, 2004

(30) Foreign Application Priority Data

Apr. 3, 2001 (DE) ..... 101 16 550

(51) Int. Cl.[7] ..... B02C 15/00
(52) U.S. Cl. ..... 241/119; 241/186.35; 241/223
(58) Field of Search ..... 241/223, 186.35, 241/119

(56) References Cited

U.S. PATENT DOCUMENTS 2,833,481 A * 5/1958 Perks ..... 241/30
3,709,274 A * 1/1973 Marek et al. ..... 83/13
4,059,235 A * 11/1977 Bryant ..... 241/223
4,312,677 A * 1/1982 Tilby et al. ..... 127/2
4,401,205 A * 8/1983 Komossa et al. ..... 198/524
6,135,374 A * 10/2000 Hansen et al. ..... 241/46.013
6,588,688 B1 * 7/2003 Rossler ..... 241/35

FOREIGN PATENT DOCUMENTS

| | | |
|---|---|---|
| AT | 400 684 B | 2/1996 |
| DE | 27 26 038 A | 12/1977 |
| DE | 34 32 553 A | 3/1986 |
| DE | 88 05 885 U | 7/1988 |

* cited by examiner

*Primary Examiner*—Joe Dillon, Jr.
(74) *Attorney, Agent, or Firm*—Buchanan Ingersoll PC

(57) ABSTRACT

A device for supplying material to a container, particularly for supplying raw material to a vertical mill with air flow conveying in a milling plant. A conveyor is provided for the material, whereof an end region is located in a feed device. The feed device and the end region of the conveyor located therein are incorporated into the pressure system of the container or the vertical mill. The feed device can be constructed as a sandwich lock and the conveyor as a double strap belt conveyor for the material to be supplied.

24 Claims, 4 Drawing Sheets

DEVICE FOR SUPPLYING A MATERIAL

CROSS REFERENCE TO RELATED APPLICATIONS

This application claims priority to PCT/EP02/03636, filed Apr. 2, 2002, now pending, which claims priority to DE 101 16 550.1, filed Apr. 3, 2001.

BACKGROUND

The invention relates to a device for supplying material to a container.

The invention is particularly suitable for loading or filling containers and devices with material, the material being stored, processed or worked therein under an overpressure or underpressure.

A preferred field of application are milling plants, where raw material is supplied to vertical mills with air flow conveying, e.g. air-swept roller mills, with the aid of conveying devices and a feed device for milling purposes.

For charging a vertical mill with raw material to be crushed, e.g. predried raw lignite or cement clinker and fluxes, it is known to use a two or three-flap lock or a bucket wheel lock, which ensures the necessary sealing of an air-swept mill operated under an overpressure or underpressure.

However, the disadvantage is that these material locks involve high costs, which considerably increase the overall costs of a milling plant. This is in particular due to the overall height of the flap and bucket wheel locks and the arrangement thereof roughly level with a classifier cover caused by the material being discharged vertically. Besides the costs resulting from the building height, costs are also involved for the mechanical and electrotechnical equipment and for assembly and this has a negative effect on the total costs of a milling plant.

FIG. 1 shows in a partial view a milling plant 2 in the vicinity of an air-swept roller mill as a vertical mill 6 with air flow conveying. A bucket wheel lock 45 is used as the feed mechanism for the milling material to be crushed and which is supplied from a silo or hopper 37 to a conveyor 43. The bucket wheel lock 45 is positioned above a classifier cover 46 of the vertical mill 6. The not shown milling material passes via a feed chute 47 into the milling area 12 of the vertical mill 6. FIG. 1 illustrates the considerable building height, the necessary structural plant parts and the length of the conveyor 43, which raise the total cost of the milling plant.

Austrian patent 400 684 discloses a device for supplying raw coal to a mill which is under pressure. In order to limit to a minimum the parts which have to be designed in pressure shock-resistant manner, following a silo the supply device has a first conveying line, followed by a feed bunker, a second conveying line, an intermediate bunker and a third conveying line. The third conveying line is in the form of a trough chain conveyor, which serves as a proportioning member and is fully located in a pressure shock-resistant casing. By means of the supply shaft issuing centrally into the classifier cover of the mill, the raw coal passes from the third conveying line into the mill. As a result of the superimposed bunkers and the horizontally positioned, three conveying lines, the overall supply device has a relatively large overall height and requires corresponding capital, assembly and energy costs.

DE 88 05 885 U1 discloses a mill for crushing moist milling material with a feed chute for supplying said material. A conveyor belt projects into the sloping feed chute, which extends into an introduction opening in the mill casing cover. In order to protect the conveyor belt parts located in the feed chute against the rising hot gases from the mill in the case of a power failure, a stack is provided which is connected to the feed chute. At the connection point of the stack in the feed chute is provided a shutoff valve as a movable part of a gas deflector, which in normal operation shuts off the stack, whereas in the case of a power failure it opens the stack and shuts off the feed chute. The additional components located in the cover-side supply device increase the overall height, as well as the capital expenditure and control technology expenditure of the milling plant.

An elevator conveyor for bulk materials with two continuous conveyor belts, which engage on one another on their longitudinal edges and whereof at least one passes in a vertical area within an air box is known from DE 27 26 038 C2. Pretensioning means and sealing strips fixed to the air box are provided for the necessary marginal sealing of the conveyor belts.

A double band or strap belt conveyor is known from DE 34 32 553 A1. In order to be able to convey sticky, slurry-like and highly free-flowing bulk materials reliably and without any demixing risk, the cover belt strap has longitudinal and transverse reinforcements between which are formed indentations for receiving the material to be conveyed. The indentations or conveying spaces are sealed to the other side by the second, flat strap of the conveyor belt. Through longitudinal guides comprise U-shaped steel section portions and ensure the necessary seals for the conveying spaces.

SUMMARY

The object of the invention is to provide a device for supplying material to a container, particularly raw material to be crushed in a vertical mill, which has a particularly simple and cost-saving construction and an optimized material feed as well as a smaller overall height of the plant and reduced control technology expenditure and an efficient milling and classifying process.

According to the invention the object is achieved by the characterizing features of claim 1. Appropriate and advantageous developments appear in the subclaims and the description relative to the drawings.

It is a fundamental idea of the invention to use as a feed device constructed for receiving an end region of a conveyor for the material to be supplied to a container and incorporated with the end region of the conveyor received in the pressure system of the container, e.g. a vertical mill with air flow conveying, a sandwich lock with a gas-tight and/or pressure-tight casing and as a conveyor to use a double strap conveyor with a double strap belt and to position the sandwich lock for a lateral supply and feeding of the material in the vicinity of a feed opening of the container or the casing of the vertical mill.

According to the invention, the sandwich lock casing has a passage opening for the double strap belt and a lower and an upper slot opening for the lower and upper strap belts to be returned and which for maintaining the pressure level in the sandwich lock and in the container or vertical mill are provided with seals.

Particularly for milling plants and the raw material charging of an air-swept roller mill, it is advantageous if the conveyor for the raw material is constituted by a double band or strap conveyor, which is terminally connected with a correspondingly constructed lock as the feed device. The supply device according to the invention makes unnecessary material locks, such as two or three-flap locks or bucket wheel locks, so that there are considerable cost savings in connection with construction, mechanical equipment and the associated electrical equipment.

A lock integratable into a double strap conveyor can be constructed as a sandwich lock which, compared with the known material locks, has an extremely simple construction and a relatively low overall height. This also reduces the manufacturing and assembly costs. It is particularly advantageous that the device allows a lateral supply and charging of the material and economizes approximately 7 to 8 m building height. Further advantages are associated with the in particular air-tight, continuous material conveying and feeding with the aid of the double strap belt conveyor, in which conveying can take place horizontally, vertically and/or in sloping manner with any random inclination angle. Whereas in the case of the known material locks there is generally a discontinuous material entry, with the conveyor-feed unit according to the invention it is possible to implement a continuous material flow entry. This provides optimization possibilities for a plant and in particular a milling and classifying process in a milling plant, which brings about a reduction in energy consumption and leads to significant ecological advantages.

According to the invention it is appropriate to construct the sandwich lock with a gas-tight and/or pressure-tight casing, which is rearwardly adjacent to a container wall or mill casing and connected by means of a feed opening to the milling and/or classifying area of the mill. As a result of the fact that the material to be supplied is conveyed in a double strap belt and enclosed in sandwich-like manner between a lower and an upper strap belt, the advantageous possibility exists of an air-tight termination or sealing of the double strap belt, so that from the material side a secondary or infiltrated air entry can largely be excluded.

It is appropriate to seal and in particular seal several times upstream of the sandwich lock, the double strap belt with the material enclosed therein. As sealing means are suitable rolling seals, sliding seals and bristle seals. It is appropriate for a sealed material supply and a smooth material entry into the vertical mill without secondary air entry or exit to provide the double strap belt formed by a lower and an upper strap belt marginally with sealable, material-free overlap areas, which are appropriately almost planar.

The end region of the double strap conveyor extending into the sandwich lock has deflection drums for the lower and the upper strap belt. The deflection drums are appropriately constructed in complementary manner to the strap belts and are arranged in displaced manner in the sandwich lock in such a way that the upper strap belt is positioned upstream of the lower deflection drum for releasing the material to the conveyor. The lower deflection drum serves as an ejection or release device for the material and is so positioned with respect to the feed opening in the container or vertical mill that the material passes into the feed opening and the container or vertical mill.

If the strap belts are profiled in trough-shaped manner between the marginal, substantially planar overlap areas and rest on one another homologously with their overlap areas, a cross-sectionally biconvex reception space for the material to be conveyed is formed and can be sealed in a particularly simple manner.

Since as a result of the feed opening in the container or in the vertical mill, the same pressure prevails in the sandwich lock casing as in the vertical mill, according to the invention are formed in the vicinity of the passage opening for the double strap belt with enclosed material and a lower and an upper slot-like opening for the lower or upper, deflected and returned strap belt.

Appropriately there are labyrinth packings for the returning, upper strap belt and for the returning, lower strap belt. The passage opening positioned between the slot openings is advantageously constructed in vertically adjustable manner at least in an upper sealing area for adaptation to a differently arched, upper strap belt. It is e.g. possible to provide sealing laminas, which can be pressed resiliently or in sliding manner on the upper strap belt of the double strap belt. The lower strap belt is appropriately relatively stable and provided with a constant trough for receiving the material. In order to maintain the trough-shaped construction even in the deflected, returned, lower strap belt, it is appropriately to correspondingly position backing rolls. The seal can be constituted by a labyrinth packing.

The passage opening and the lower and upper slot openings can be constructed independently of the seals used in complementary manner to the cross-section of the double strap belt, as well as the deflected, lower and upper strap belt. It is particularly advantageous that through the use of a double strap belt and a sandwich lock in the vicinity of a feed opening, the raw material can be supplied in free-falling manner or forcibly guided to the container or milling area. The raw material can directly reach the centre of the mill through an adjustable speed of the double strap belt as a function of the spacing of the lower deflection drum from the feed opening.

The essential advantages of the device according to the invention are low structural and machine costs for the material supply as a result of the arrangement of the sandwich lock above the milling or grinding rollers in a lateral area of the mill casing or in the connection area between the mill and classifier casing. The manufacturing and assembly costs for the sandwich lock and double strap conveyor are relatively low. Another advantage is that with the double strap conveyor, which can be positioned horizontally, vertically and with any random inclination angle, a continuous material feed is ensured. This leads to a lower energy consumption for the device and to an optimized milling and classifying process.

The invention is described in greater detail hereinafter relative to highly diagrammatic drawings, wherein show:

DETAILED DESCRIPTION

Figure 1:
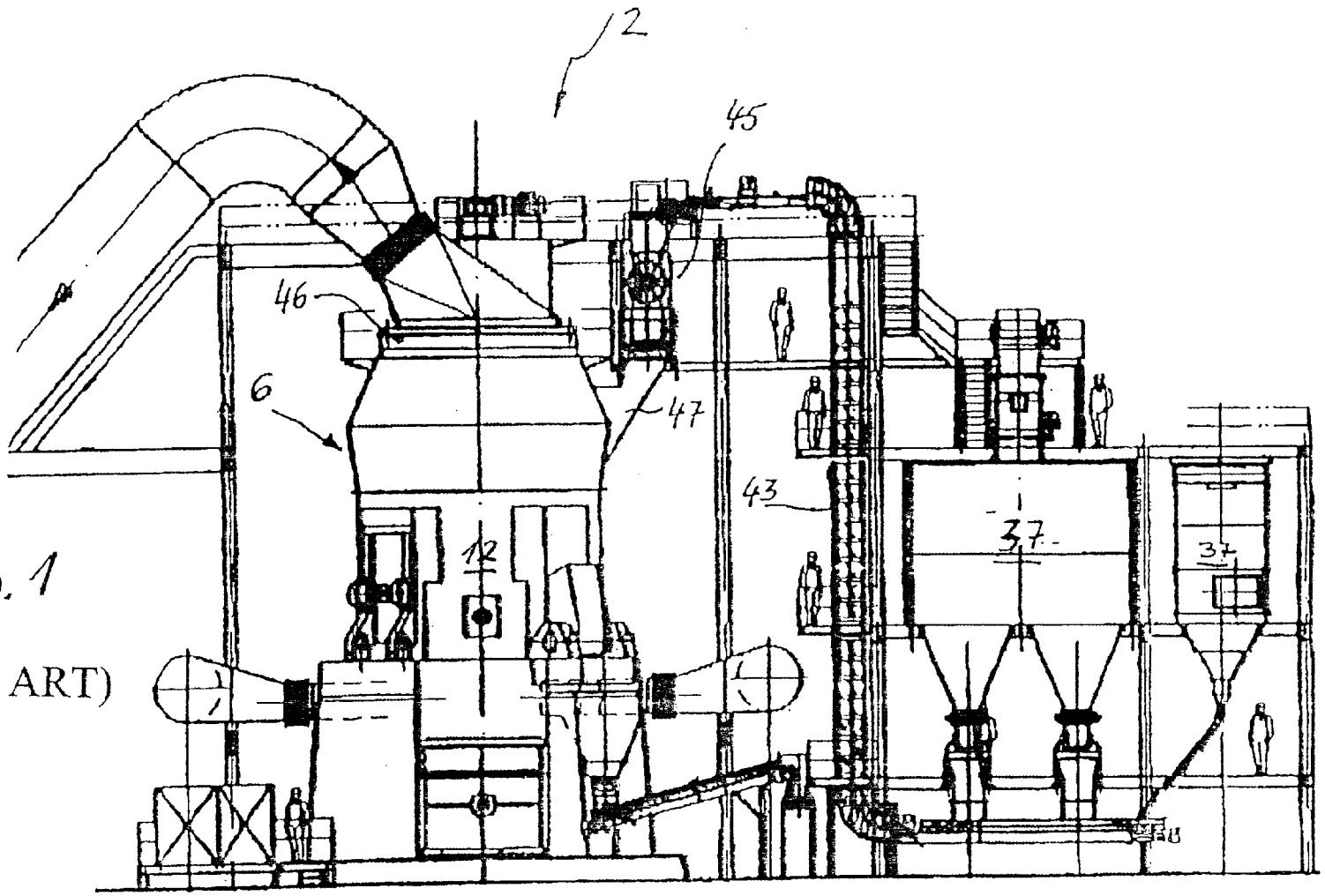
Fig. 1 (PRIOR ART)
FIG. 1 A partial view of a grinding plant with a supply device for the raw material according to the prior art.
Figure 2:
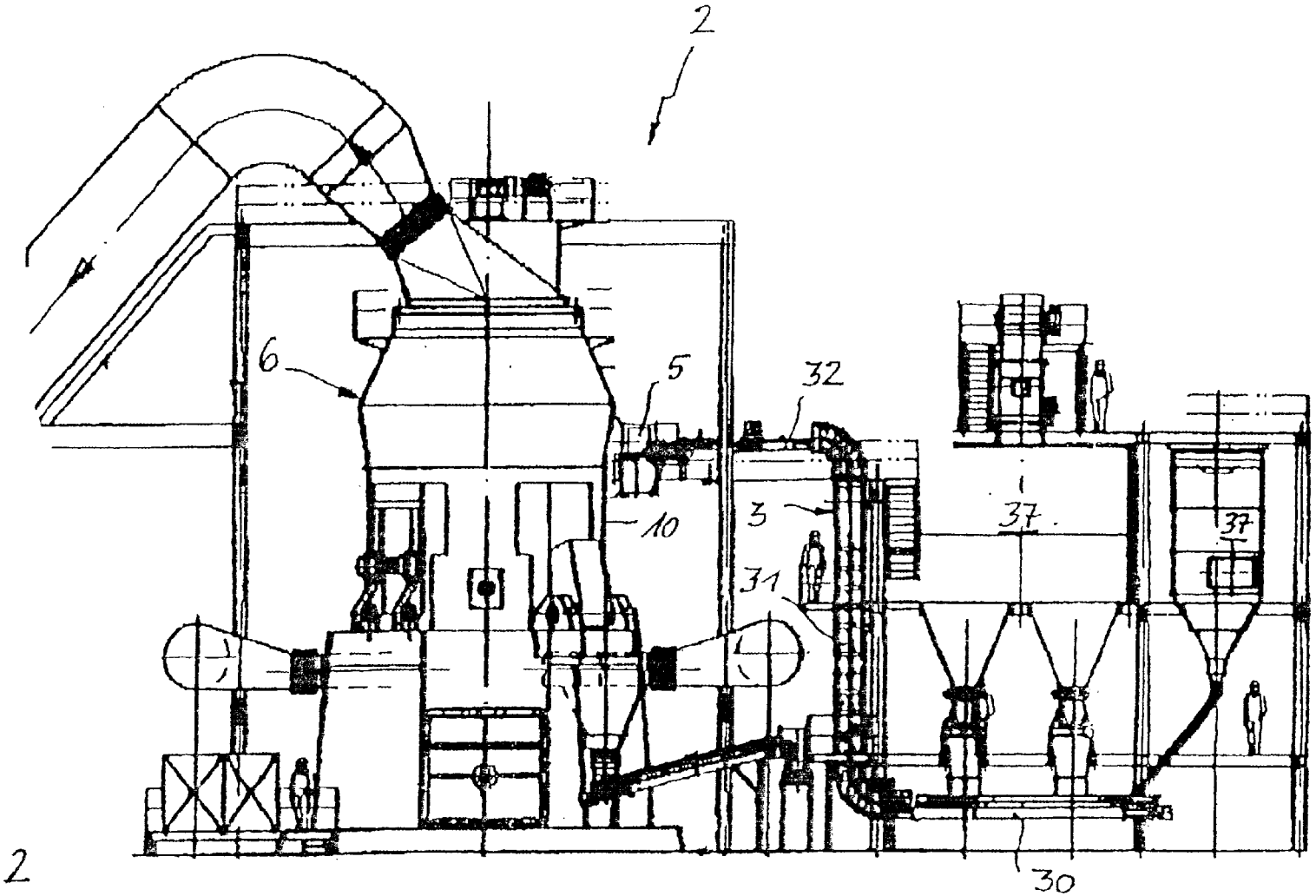
FIG. 2 A partial view of a grinding plant with a supply device according to the invention.

The partial view of a milling plant 2 shown in FIG. 2 has in the same way as the prior art-illustrating FIG. 1, an air-swept roller mill as the vertical mill 6 with air flow conveying and silos 37, in which is stored the material to be crushed in the vertical mill 6. The supply device according to the invention has as the conveyor a double strap conveyor 3 and as the feed device for the not shown material supplied by the double strap conveyor 3, a lock adapted to the latter and which is referred to hereinafter as a sandwich lock 5.

Said sandwich lock 5 is fixed in gas-tight and/or pressure-tight manner in the vicinity of a feed opening 11 (cf. FIG. 3) to the casing 10 of the vertical mill 6.

A comparison of the prior art milling plant in FIG. 1 and the milling plant according to FIG. 2 with a material supply according to the invention, which has a sandwich lock 5 and a double strap conveyor 3 cooperating therewith shows that there is a much lower building height in the case of the milling plant 2 of FIG. 2.

In this embodiment the double strap conveyor 3 is provided in the vicinity of the silos 37 with a lower, horizontal conveying area 30 to which is connected a vertical conveying area 31, which extends over an upper, horizontal conveying area 32 into the sandwich lock 5. Considerable cost savings arise due to the reduced overall height and the reduced plant and structural component costs. Fundamentally the orientation of the double strap conveyor 3 can be in accordance with the given circumstances and requirements of the plant and can e.g. be positioned over the entire conveying path vertically and/or horizontally and/or inclined with any random inclination angle.

Figure 3:
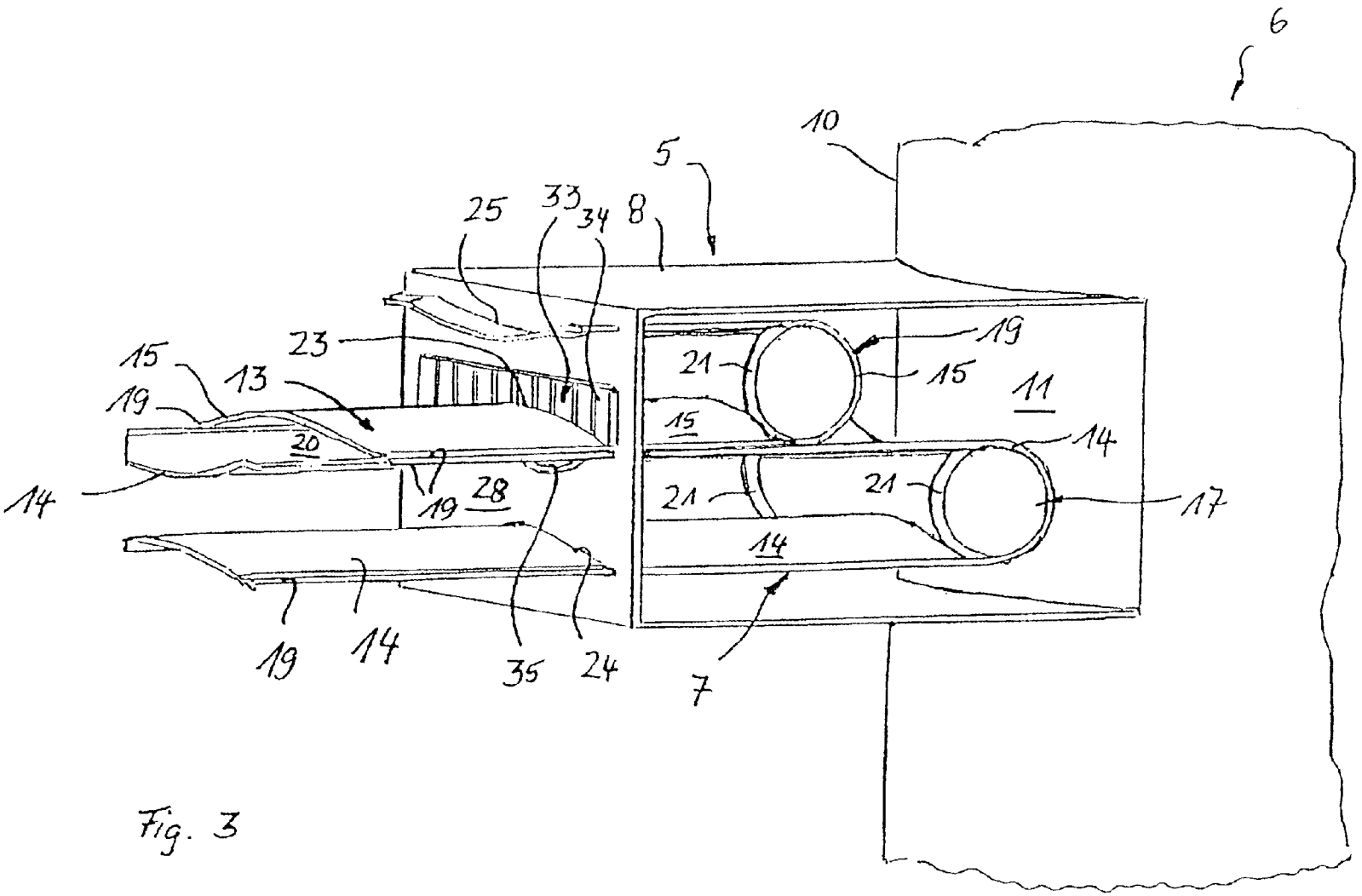
FIG. 3 A perspective view of a supply device according to the invention on a container wall shown only in detail form.
Figure 4:
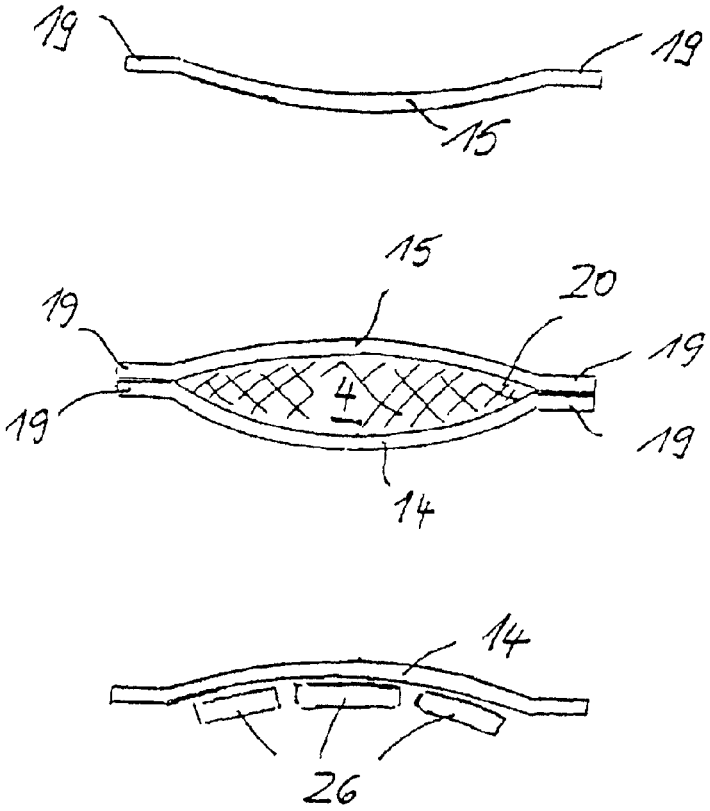
FIG. 4 A highly diagrammatic representation of a double strap belt with enclosed material, as well as a deflected, lower and upper strap belt.

FIGS. 3 and 4 illustrate the construction and arrangement of a sandwich lock 5 on a vertical mill 6 with air flow conveying, only the area of the casing 10 of vertical mill 6 being shown. The sandwich lock 5 is constructed in box-like manner and has a casing 8 with a front side 28, which is provided with a passage opening 23 for the double strap belt 13 with the material 4 enclosed therein and which is in particular terminated in air-tight manner (cf. FIG. 4). An end region 7 of the double strap conveyor 3 is located within the casing 5 and is consequently incorporated into the pressure system of the sandwich lock 5 and the vertical mill 6 by means of the feed opening 11. In order to avoid secondary air entry or exit, the double strap belt 13 with the material received therein and the sandwich lock 5 are sealed, the sandwich lock 5 being shown in FIG. 3 without a front side wall in order to illustrate the construction of the end region 7 and the deflection of the double strap belt 13.

The double strap belt 13 has a lower strap belt 14 and an upper strap belt 15. For the construction of a reception area 20 for the material 4 (FIG. 4), the lower belt 14 and the upper belt 15 are constructed in trough-shaped manner and in the vicinity of the marginal, material-free overlap areas 19, are superimposed in mirror symmetrical manner, so that a cross-sectionally biconvex reception space 20 is formed (cf. also FIG. 4). Through suitable sealing devices, which are appropriately positioned upstream of the sandwich lock 5 and which are not shown, the double strap belt 13 is preferably sealed several times, so that on the material side a secondary air introduction into the sandwich lock 5 and vertical mill 6 can be largely excluded.

The end region 7 of the double strap conveyor 3 received within the sandwich lock 5 has a lower deflection drum 17, which is positioned relatively close to the feed opening 11. An upper deflection drum 18 for the upper strap belt 15 is positioned in displaced manner, so that the not shown material resting on the lower, further extending strap belt 14 reaches an ejection point formed by the deflection drum 17 and, as a function of the speed of the double strap belt 13 and the spacing from the feed opening 11, can be ejected virtually centrally into the vertical mill 6.

The deflection drums 17, 18 are constructed in complementary manner to the trough-shaped strap belts 14, 15 resting on one another in mirror symmetrical manner. Corresponding to the virtually planar, material-free overlap areas 19, the deflection drums 17, 18 are provided with circular cylindrical front areas 21, whilst between the circular cylindrical front areas 21 and in complementary manner to the trough-shaped strap belts 14, 15, the deflection drums 17, 18 are virtually constructed as a one-sheet hyperboloid.

In order to ensure the necessary sealing of the sandwich lock 5 relative to the atmospheric pressure, also in the vicinity of the front passage opening 23 and a lower slot opening 24 for the deflected, lower strap belt 14, as well as an upper slot opening 25 for the deflected, upper strap belt 15, they are provided with seals, whereof FIG. 3 only shows an upper sealing area 34 of a seal 33 for the passage opening 23 and a lower sealing area 35. The upper sealing area 35 has vertically adjustable sealing laminas, which rest in resilient or sliding manner on the upper strap belt 15. The lower sealing area 35 of seal 33 is only partly shown. The seals of the lower slot opening 24 and upper slot opening 25 are not shown. These seals and the lower sealing area 35 can in particular be constructed as a labyrinth packing.

FIG. 4 shows the construction and arrangement of the double strap belt 13 between the upper, deflected strap belt 15 and the lower, deflected strap belt 14. For supporting the trough-shaped area of the deflected, lower strap belt 14 backing rolls 26 are provided. The upper, deflected strap belt 15 in principle requires no deflection drums. The double strap belt 13 between the deflected, lower and upper strap belt 14, 15 has the milling material 4 to be supplied in the cross-sectionally biconvex reception area 20.

What is claimed is:

1. A device for supplying material to a vertical mill with air flow conveying, with a conveyor for conveying the material and with a feed device by means of which the material can be supplied to said vertical mill, an end region of said conveyor being located in said feed device, said vertical mill comprises a casing and a pressure system;

said feed device and said end region of the conveyor received therein are incorporated into said pressure system of said vertical mill, comprising said conveyor is a double strap conveyor and said feed device is a sandwich lock;

said double strap conveyor has a double strap belt with a lower strap belt and an upper strap belt, between which milling material is enclosed as material to be supplied to said vertical mill;

said double strap belt in the end region located in said sandwich lock has a lower deflection drum for said lower strap belt and an upper deflection drum for said upper strap belt;

said upper deflection drum being located upstream of said lower deflection drum in the conveying direction;

said sandwich lock is laterally fixed to said casing of said vertical mill and a feed opening is formed in said casing of said vertical mill in an ejection direction of said milling material.

2. The device according to claim 1, wherein said sandwich lock comprises a casing which has a passage opening for said double strap belt with the material enclosed therein and a lower and an upper slot opening for said lower and upper strap belt to be returned and said passage opening and said upper and lower slot opening are provided with seals for maintaining a pressure level in said sandwich lock and in said vertical mill.

3. The device according to claim 2, wherein said passage opening and said lower and upper slot opening are in each case adapted to the contour of the double strap belt with the material enclosed therein.

4. The device according to claim 1, wherein at least in said end region of said double strap conveyor received in said sandwich lock, the material to be supplied is enclosed in air-tight manner between said lower and the upper strap belt.

5. The device according to claim 1, wherein said double strap belt is marginally provided with material-free overlap areas and is constructed in sealable manner to avoid a secondary air introduction into said sandwich lock and said vertical mill.

6. The device according to claim 1, wherein sealing means are provided for sealing said double strap belt with the material enclosed therein, and said sealing means, which are constructed as rolling seals, are positioned upstream of said sandwich lock.

7. The device according to claim 1, wherein an overpressure prevails in said vertical mill and in said sandwich lock and said sandwich lock has a casing which is constructed in gas-tight manner.

8. The device according to claim 1, wherein said lower strap belt and said upper strap belt are constructed in trough-shaped manner and have material-free, virtually planar overlap areas which are superimposed in mirror symmetrical manner in such a way that a cross-sectionally biconvex reception space for said milling material is formed.

9. The device according to claim 8, wherein said deflection drums of said double strap conveyor are constructed in complementary manner to the trough-shaped strap belts and between circular cylindrical front areas are virtually shaped like a one-sheet hyperboloid.

10. The device according claim 8, wherein backing rolls for maintaining the trough-shaped construction are provided at least in the vicinity of the deflected, lower strap belt.

11. The device according to claim 2, wherein said seal of said passage opening for said double strap belt has an upper and a lower sealing area; said upper sealing area is vertically adjustable and adaptable to the convexity of said upper strap belt and a constant sealing area is provided for said lower strap belt.

12. The device according to claim 11, wherein said vertically adjustable, upper sealing area of said seal has sealing laminas, which rest in resilient manner on said upper strap belt of said double strap belt, and said lower sealing area of said seal and said seals of the lower and upper slot openings are constructed in labyrinth packing form.

13. The device according to claim 1, wherein said double strap conveyor has a lower, virtually horizontal conveying area for receiving raw material, including from silos, a vertical conveying area and an upper, virtually horizontal conveying area and said upper, horizontal conveying area extending into the sandwich lock.

14. The device according to claim 1, wherein said sandwich lock has a box-shaped casing with a front side, which faces said feed opening and in which are formed said passage opening and said lower and upper slot opening.

15. The device according to claim 1, wherein the milling material supplied to said double strap belt and ejected into said feed opening passes in free-falling manner into the milling area of said vertical mill.

16. The device according to claim 1, wherein the speed of said double strap belt is adjustable as a function of the spacing of said lower deflection drum from said feed opening in such a way that the milling material passes directly to the centre of said vertical mill.

17. The device according to claim 2, wherein said passage opening and said lower and upper slot opening are in each case adapted to said deflected, lower and upper strap belt.

18. The device according to claim 1, wherein sealing means are provided for sealing said double strap belt with the material enclosed therein, and said sealing means, which are constructed as sliding seals, are positioned upstream of said sandwich lock.

19. The device according to claim 1, wherein sealing means are provided for sealing said double strap belt with the material enclosed therein, and said sealing means, which are constructed as bristle seals, are positioned upstream of said sandwich lock.

20. The device according to claim 1, wherein an underpressure prevails in said vertical mill and in said sandwich lock and said sandwich lock has a casing which is constructed in gas-tight manner.

21. The device according to claim 1, wherein an underpressure prevails in said vertical mill and in said sandwich lock and said sandwich lock has a casing which is constructed in pressure-right manner.

22. The device according to claim 1, wherein an overpressure prevails in said vertical mill and in said sandwich lock and said sandwich lock has a casing which is constructed in gas-tight and pressure-right manner.

23. The device according to claim 11, wherein said vertically adjustable, upper sealing area of said seal has sealing laminas, which rest in sliding manner on said upper strap belt of said double strap belt, and said lower sealing area of said seal and said seals of the lower and upper slot openings are constructed in labyrinth packing form.

24. The device according to claim 1, wherein the milling material supplied to said double strap belt and ejected into said feed opening passes in forcibly guided manner into the milling area of said vertical mill.

* * * * *